United States Patent [19]

Hellgren

[11] 4,402,436

[45] Sep. 6, 1983

[54] DISCHARGE GATE DEVICE FOR BULK CARGO HOPPERS, PARTICULARLY HOPPERS IN BULK CARGO VESSELS

[75] Inventor: Leif A. Hellgren, Kungsängen, Sweden

[73] Assignee: AB Nordstroms Linbanor, Enkoping, Sweden

[21] Appl. No.: 282,164

[22] Filed: Jul. 10, 1981

[30] Foreign Application Priority Data

Jul. 10, 1980 [SE] Sweden ..... 8005082

[51] Int. Cl.[3] ..... B65D 47/00

[52] U.S. Cl. ..... 222/561; 222/559; 49/209; 105/304

[58] Field of Search ..... 222/504, 505, 512, 537, 222/542, 559, 561; 292/193; 49/209; 105/298, 299, 304

[56] References Cited

U.S. PATENT DOCUMENTS

| | | | |
|---|---|---|---|
| 1,667,690 | 4/1928 | Hamm | 222/561 |
| 2,614,733 | 10/1952 | Anderson | 222/559 |
| 4,249,679 | 2/1981 | Dillman | 222/561 |
| 1,219,7374 | 3/1917 | Heilig | 222/561 |

FOREIGN PATENT DOCUMENTS

| | | |
|---|---|---|
| 243627 | 2/1912 | Fed. Rep. of Germany . |
| 2443732 | 3/1975 | Fed. Rep. of Germany . |
| 338251 | 8/1971 | Sweden . |

*Primary Examiner*—Joseph J. Rolla
*Assistant Examiner*—Charles C. Compton
*Attorney, Agent, or Firm*—Cushman, Darby & Cushman

[57] ABSTRACT

In a discharge gate arrangement for cargo hoppers for bulk cargo, a cover is guided for sliding in its own plane between a closed and an open position. The cover is also mounted for movement towards and away from the plane of the discharge opening at the end of the closing movement and the beginning of the opening movement, respectively. In the closed position the cover presses against a gasket laid around the opening, providing a gas- and liquid-tight seal.

2 Claims, 4 Drawing Figures

FIG. 3
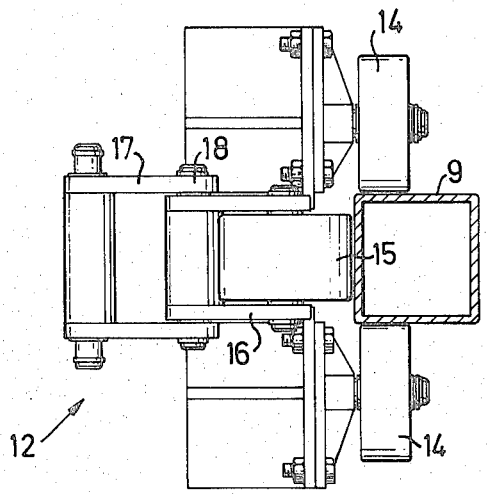
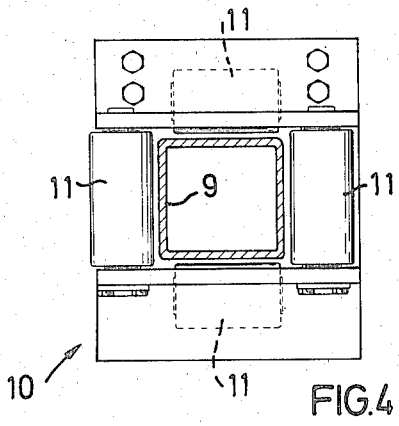
FIG. 4

DISCHARGE GATE DEVICE FOR BULK CARGO HOPPERS, PARTICULARLY HOPPERS IN BULK CARGO VESSELS

The present invention relates to a device in cargo hoppers in bulk cargo vessels, which has a downwardly directed discharge opening which can be sealed by a movably mounted hatch cover.

Known covers for discharge openings in hoppers for bulk cargo are usually made as a chute pivoted at one edge of the opening, which when swung up closes the opening so much that the material cannot run out, and which is swung down to various positions to regulate the emptying, with the chute directing the material to an underlying conveyer. A hatch cover of this type cannot be made to seal the opening completely, and this, for example, involves risks when transporting material which can generate explosive gases. Certain materials thus require the use of protective gases. The hopper is also limited to the storage of material in powder form and cannot be used for liquid or gaseous material.

The purpose of the present invention is to achieve a device for cargo hoppers which makes it possible to seal the discharge opening with a completely gas-tight seal to, on the one hand, make it safer to transport material which can generate explosive gases, and, on the other hand, make it possible to transport gases and liquids.

This is achieved according to the invention by the cover being mounted firstly for sliding in its plane between a lower position covering the opening and an upper position exposing the opening, and secondly for movement towards the plane of the opening at the end of the sliding movement to the lower position, and away from the plane of the opening upon initial sliding movement towards the upper position.

Figure 1:
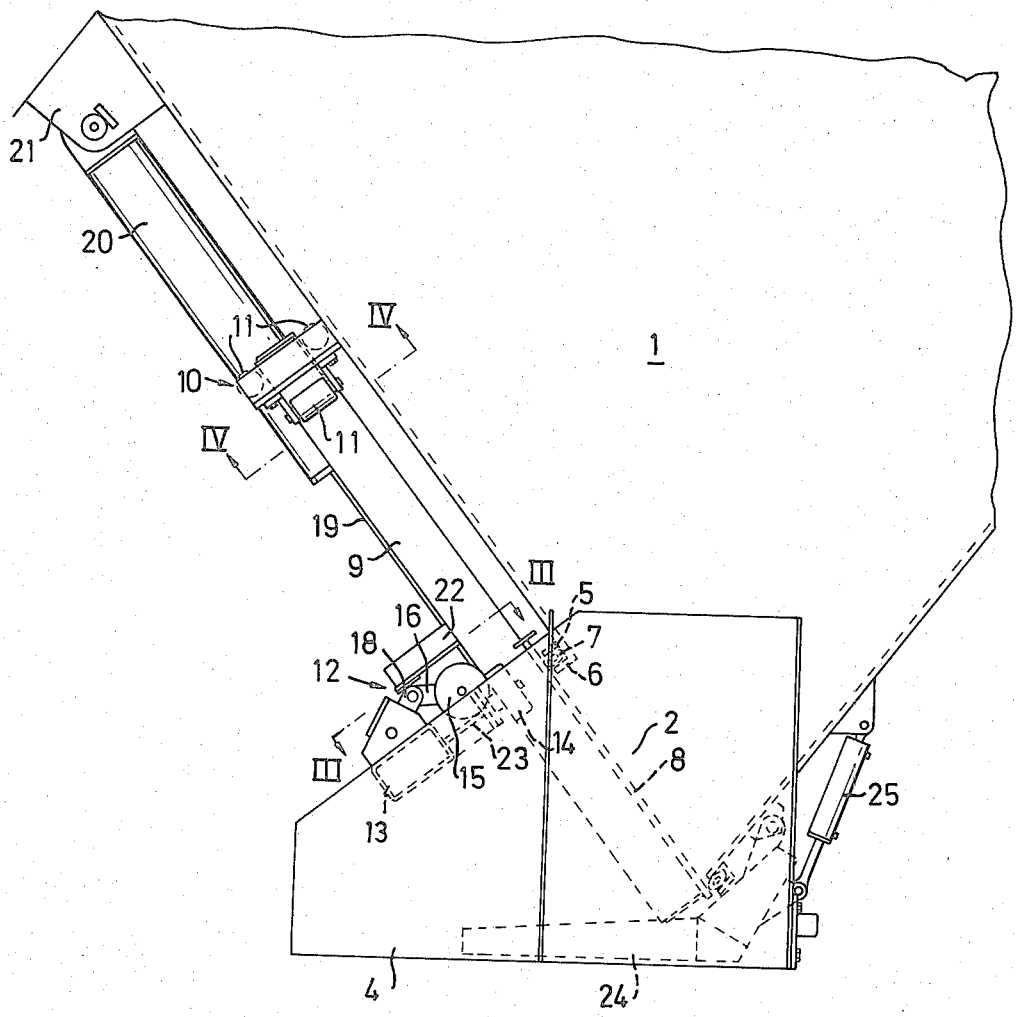
Figure 2:
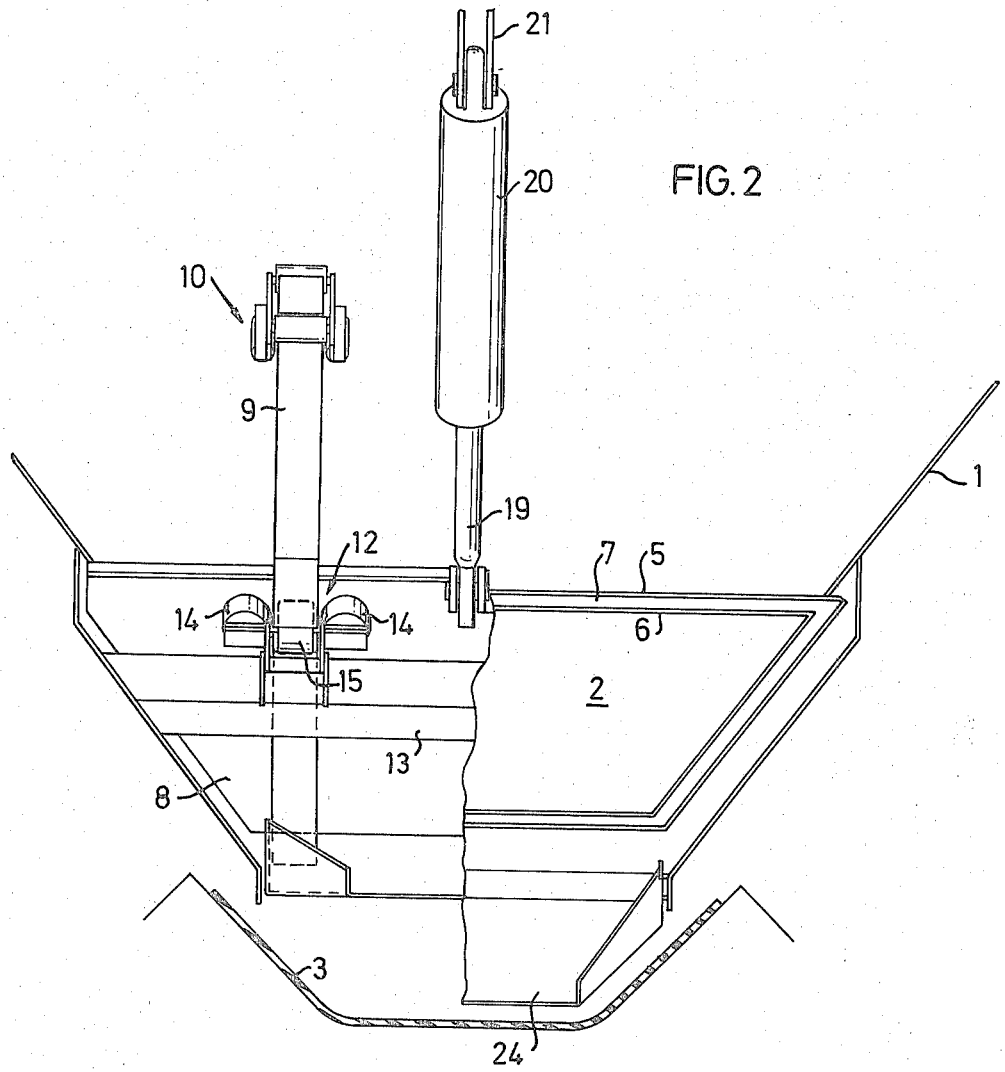

The invention will be described in more detail below with reference to an example shown in the accompanying drawings, in which FIG. 1 is a side view of the lower portion of a cargo hopper with the device according to the invention, FIG. 2 is a front view of the device in FIG. 1 in partial cut-away, FIG. 3 is a view along the line III—III in FIG. 1, and FIG. 4 is a view along the line IV—IV in FIG. 1.

In FIGS. 1 and 2, 1 designates the lower portion of a cargo hopper of the type occurring in bulk cargo ships, for example. The hopper has a downwardly directed discharge opening 2 for emptying the material from the pocket onto an underlying belt conveyor 3. The opening 2 is surrounded by a so-called loading box 4.

A pair of flanges 5, 6 run around the edge of the opening 2 having between them a gasket in the form of a hose 7 of flexible material which, when lying between the flanges 5, 6, has an elliptical cross section. The opening can be closed by a flat cover 8, which is shown in the closed position in FIG. 1, in which it abuts against the gasket 7 to establish a gas- and liquid-tight closure of the opening 2.

The cover 8 is welded to a pair of box girders 9 with square cross section, which are mounted symmetrically in relation to the centre line of the cover and of which only one is shown in FIGS. 1 and 2. Each girder 9 is guided by an upper guide 10 fixed to the wall of the hopper and which has four guide rollers 11 arranged in a square, between which the girder 9 can be displaced. Furthermore there is a lower guide 12 which is mounted on a beam 13 welded to the loading box 4. The guide 12 has a pair of rollers 14 which roll against opposite sides of the girder 9, and a roller 15 which rolls against the side of the girder facing away from the cover 8. The roller 15 is rotatably journalled in an arm 16 which is in turn pivotally jointed to another arm 17. The arm 16 and 17 form a toggle joint 18 pointed towards the upper guide.

The sliding of the cover is achieved with the aid of a hydraulic piston-cylinder arrangement, the piston 19 being jointed to the cover and the cylinder 20 being jointed to a bracket 21 welded to the hopper.

When the cover 8 is slid to its lowest position, a stop 22 mounted on each girder presses against the toggle joint 18, with the result that the roller 15 rolls to the right, as seen in FIG. 1, on a plate 23 thus pressing against the girder 9 so that the cover 8 is pressed against the gasket 7.

When opening the cover, the hydraulic device 19, 20 pulls the cover in its plane diagonally upwards, whereby the stop 22 loses contact with the toggle joint 18 so that the pressure of the roller 15 against the girder 9 ceases. Due to the force of gravity, the cover 8 will swing somewhat so that it loses contact with the gasket 7. This swinging-out beings immediately as the cover moves upwards. This initial upward movement lies within the deformation range of the gasket, thus avoiding wear by the cover against the gasket during opening and closing. This assures a long life of the gasket even when it is necessary to move the cover back and forth to regulate the flow of cargo when unloading.

A chute 24 is pivoted to the lower edge of the opening 2, and is controlled with the aid of a hydraulic cylinder 25. The material running out through the opening 2 is guided by the chute down onto the underlying conveyor belt 3.

Since it is the force from the hydraulic piston-cylinder arrangement 19, 20 which produces, via the roller 15, the pressing force against the gasket when the stop 22 is pressed against the toggle joint 18, this means that the pressing force against the gasket ceases if the hydraulic system loses pressure for some reason. In order to assure that the cover is held pressed against the gasket under all conditions, the device is provided with security means which are not shown in more detail here. For example, a safety valve can be incorporated into the hydraulic system which prevents the hydraulic cylinder 20 from losing pressure. In another embodiment, an electromagnetic lock means can be arranged at the toggle joint 18 so that the roller 15 is kept pressed against the cover even if the pressure of the stop 22 against the toggle joint ceases. A manually operated lock can also be arranged which locks the toggle joint 18 in the position shown in FIG. 1.

To adjust the cover 8 so that its pressure against the gasket 7 is uniform around the entire seal, packing pieces or the like are used.

What I claim is:

1. Device for a hopper for bulk cargo, particularly a cargo hopper in bulk cargo vessels, which has a downwardly directed discharge opening closable by a movably mounted cover, characterized in that the cover is mounted firstly for sliding in its own plane between a lower position covering the opening and an upper position exposing the opening, and secondly for movement towards the plane of the opening at the end of the sliding movement to the lower position and away from the plane of the opening at the initial sliding movement toward the upper position, the cover being securely joined to guide girders running in its direction of slide, said girders being slidably mounted in guides which permit a certain pivot movement of the girders perpendicular to the slide movement, means being arranged at the end of the slide movement to the lower position to swing the cover towards the plane of the opening, and vice versa, said guides comprising spaced upper and lower sets of guide rollers, of which the lower sets have a guide roller which runs on the side of the respective guide girder facing away from the opening and which is movable towards and away from the opening to achieve said swinging of the cover, the movable guide roller being journalled in a linkage which includes a first arm at the outer end of which a guide roller is journalled, and a second arm pivotally jointed to the first arm and pivoted in a stationary attachment means, said first and second arms forming between them a toggle joint pointed toward the upper set of guides, and each guide girder having a stop which, toward the end of the slide movement to the lower position, strikes the toggle joint so as to impart, during the final movement, a movement to the guide rollers in the direction toward the opening, so that the cover is pressed against the opening by the guide roller.

2. Device according to claim 1, characterized in that a flexible gasket is laid around the edge of the opening, and that the sliding movement of the cover in its own plane and its movement towards and away from the plane of the opening are so adapted to the deformation capacity of the gasket that the cover, via its movement away from the plane of the opening, loses contact with the gasket while the sliding movement still lies within the range of deformation of the gasket.

* * * * *